US007946654B2

(12) United States Patent
Tsuber et al.

(10) Patent No.: US 7,946,654 B2
(45) Date of Patent: May 24, 2011

(54) CONTOUR FITTING CUSHION INSERT

(75) Inventors: Vasily G. Tsuber, Thornton, CO (US); Thomas J. Whelan, Longmont, CO (US)

(73) Assignee: Sunrise Medical HHG Inc., Longmont, CA (US)

( * ) Notice: Subject to any disclaimer, the term of this patent is extended or adjusted under 35 U.S.C. 154(b) by 284 days.

(21) Appl. No.: 12/341,543

(22) Filed: Dec. 22, 2008

(65) Prior Publication Data

US 2009/0160236 A1 Jun. 25, 2009

Related U.S. Application Data

(60) Provisional application No. 61/008,802, filed on Dec. 21, 2007.

(51) Int. Cl.
*A47C 7/02* (2006.01)

(52) U.S. Cl. ..... 297/452.21; 297/452.22; 297/452.23; 297/452.26; 5/653; 5/654; 5/655.3

(58) Field of Classification Search ..... 297/452.21, 297/452.22, 452.23, 452.26; 5/653, 654, 5/655.3, 657, 710, 713
See application file for complete search history.

(56) References Cited

U.S. PATENT DOCUMENTS

| | | | | |
|---|---|---|---|---|
| 4,730,610 | A | 3/1988 | Graebe | |
| 5,839,140 | A | 11/1998 | Wilkerson | |
| 6,241,320 | B1 * | 6/2001 | Chew et al. | 297/452.26 |
| 6,256,819 | B1 * | 7/2001 | Maier et al. | 5/653 |
| 6,502,263 | B1 * | 1/2003 | Rowley et al. | 5/654 |
| 6,901,617 | B2 | 6/2005 | Sprouse, II | |
| 7,350,251 | B2 * | 4/2008 | Fraser et al. | 5/654 |

OTHER PUBLICATIONS

Roho Group, Harmony Cushion sales brochure, copyright 2006 Roho, Inc. Belleville, IL.
Roho Group, nexus Spirit Cushion sales brochure, copyright 2006 Roho, Inc. Belleville, IL.

* cited by examiner

*Primary Examiner* — David Dunn
*Assistant Examiner* — Philip Gabler
(74) *Attorney, Agent, or Firm* — MacMillan, Sobanski & Todd, LLC

(57) ABSTRACT

An air insert is designed for a proper fit into a cushion pelvic loading area that has sloped walls for positioning and properly supporting the human pelvis. The air insert may be segmented, or pre-contoured by the manufacturer, so as to be designed for a proper fit into the PLA. The seat cushion and the insert will provide comfort and support to the users.

11 Claims, 15 Drawing Sheets

CONTOUR FITTING CUSHION INSERT

CROSS-REFERENCE TO RELATED APPLICATIONS

This application claims the benefit of U.S. Provisional Application No. 61/008,802, filed Dec. 21, 2007, the disclosure of which is incorporated herein by reference.

BACKGROUND OF THE INVENTION

This invention relates in general to wheelchair seats and more particularly, to wheelchair seat cushions that reduce pressure point concentrations against the contacting portions of a user's body.

Medical practitioners have long known that excessive contact pressure against a user's body over a period of time may create a harmful condition for the user's skin. This condition is especially true where a user is confined to a wheelchair creating prolonged contact with the user's trochanters or the bony prominences of the user's buttocks. When seated, the user's weight must be properly distributed in order to reduce the pressure on the bony prominences of the user's buttocks. Resilient seat cushions are often employed to increase the supporting surface exposed to the user. Fluid, air, foam and other types of resilient cushions are used to minimize the pressure on the bony prominences.

Many resilient seat cushions lack enough support, when used alone, to prevent the user's weight from excessively compressing, or bottoming out, the cushion. Seat cushion bases, often structured as foam bases, may include a pelvic loading area (PLA) to provide better support and stability to the user. Support is improved by directing load to the tissue supporting the user's trochanters. The PLA of the foam base may be formed with sloped walls to locate a seat cushion insert. Sloped walls may help to distribute the load between the user's ischial tuberosities (IT) and trochanters. Because of the sloped walls, however, it may be difficult to place an insert into the PLA without overlapping or folding of the insert. Thus, it would be desirable to provide a seating system that improves the support and load distribution of a user's weight.

SUMMARY OF THE INVENTION

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
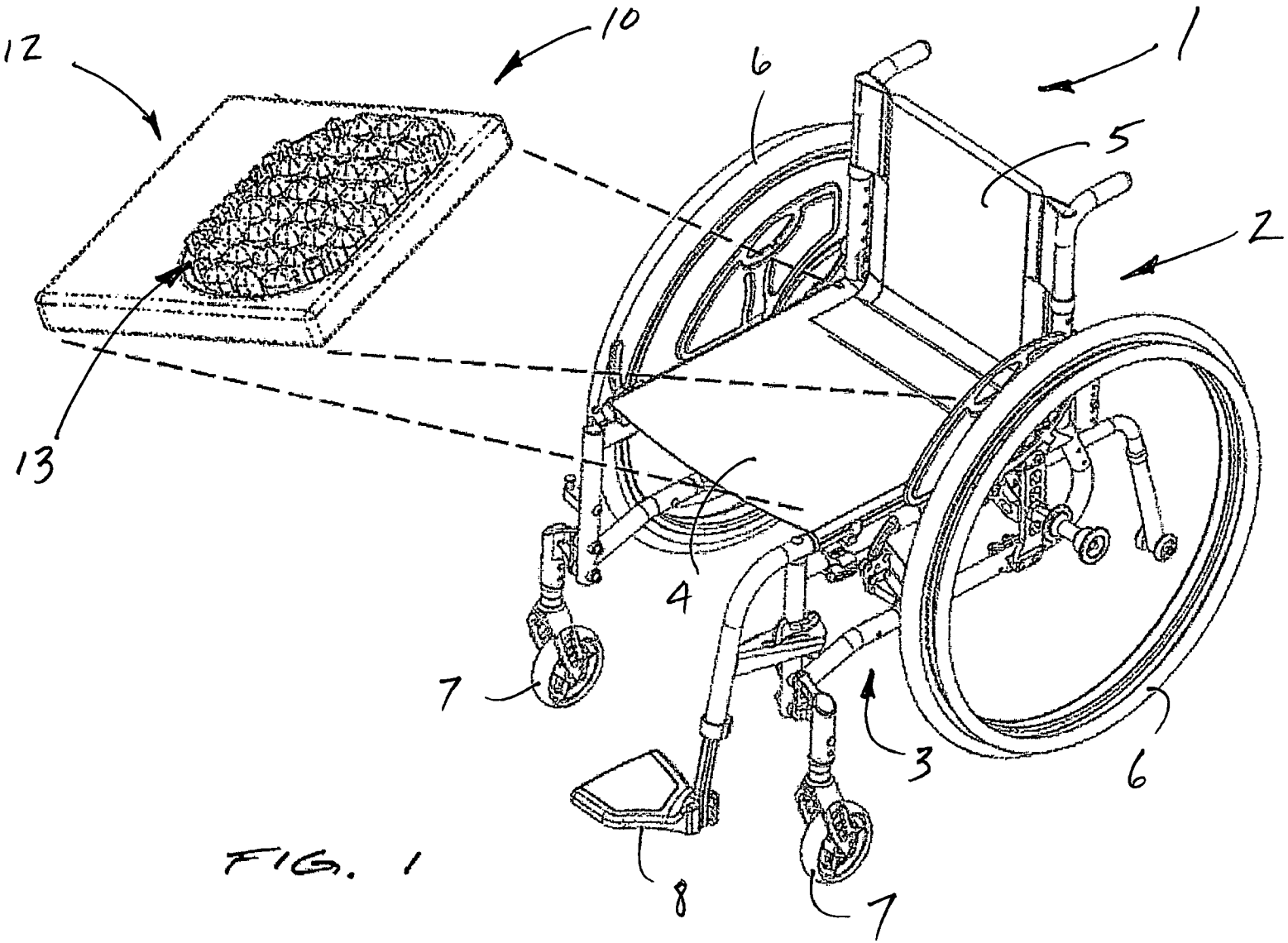
FIG. 1 is an exploded perspective view of a wheelchair and a seat cushion assembly having a contoured support base and a fluid-filled cushion insert.

Referring now to the drawings, there is illustrated in FIG. 1 an embodiment of a wheelchair and a pelvic loading area (PLA) seat cushion assembly, indicated generally at 1. The wheelchair and PLA seat cushion assembly 1 includes a wheelchair, indicated generally at 2, and a PLA seat cushion assembly, indicated generally at 10. The wheelchair 2 is known in the art and intended to represent but one environment applicable for use with the PLA cushion assembly 10. However, the PLA cushion assembly 10 is not limited to use with wheelchairs. On the contrary, the various embodiments of the PLA cushion assembly may be used in any environment and for the purposes described herein. For example, the wheelchair 2 may include variations such as power driven wheelchairs, and may further include other personal mobility vehicles, such as scooters.

The wheelchair 2 is illustrated having a frame 3 that supports a seat bottom 4 and a seat back 5. The seat bottom 4 is illustrated as a sling seat, which is known in the art, though any seat structure may be used if desired. The frame 3 further supports a pair of drive wheels 6 and a pair of front casters 7. A pair of foot rests 8 (only one shown) may be provided to support the user's feet, though such is not required. The PLA cushion assembly 10 is shown removed from the wheelchair 2 and typically is located on the seat bottom 4. The PLA cushion assembly 10 may also be provided for use between the seat back 5 and the user, if so desired. The PLA cushion assembly 10 is shown with the rear side view exposed and is preferably oriented on the seat bottom 4 as indicated by the dashed lines. The PLA cushion assembly 10 includes a contoured support base, indicated generally at 12 and further shown as a foam base, and a fluid-filled cushion insert, indicated generally at 13. Though described in the context of foam, the contoured support 12 may be made from any material capable of accommodating a pelvic loading area 14 and supporting a fluid-filled, cushion insert 13. Materials used to form the contoured support base 12 may include open and closed cell foams, plastics, and the like.

Figure 2A:
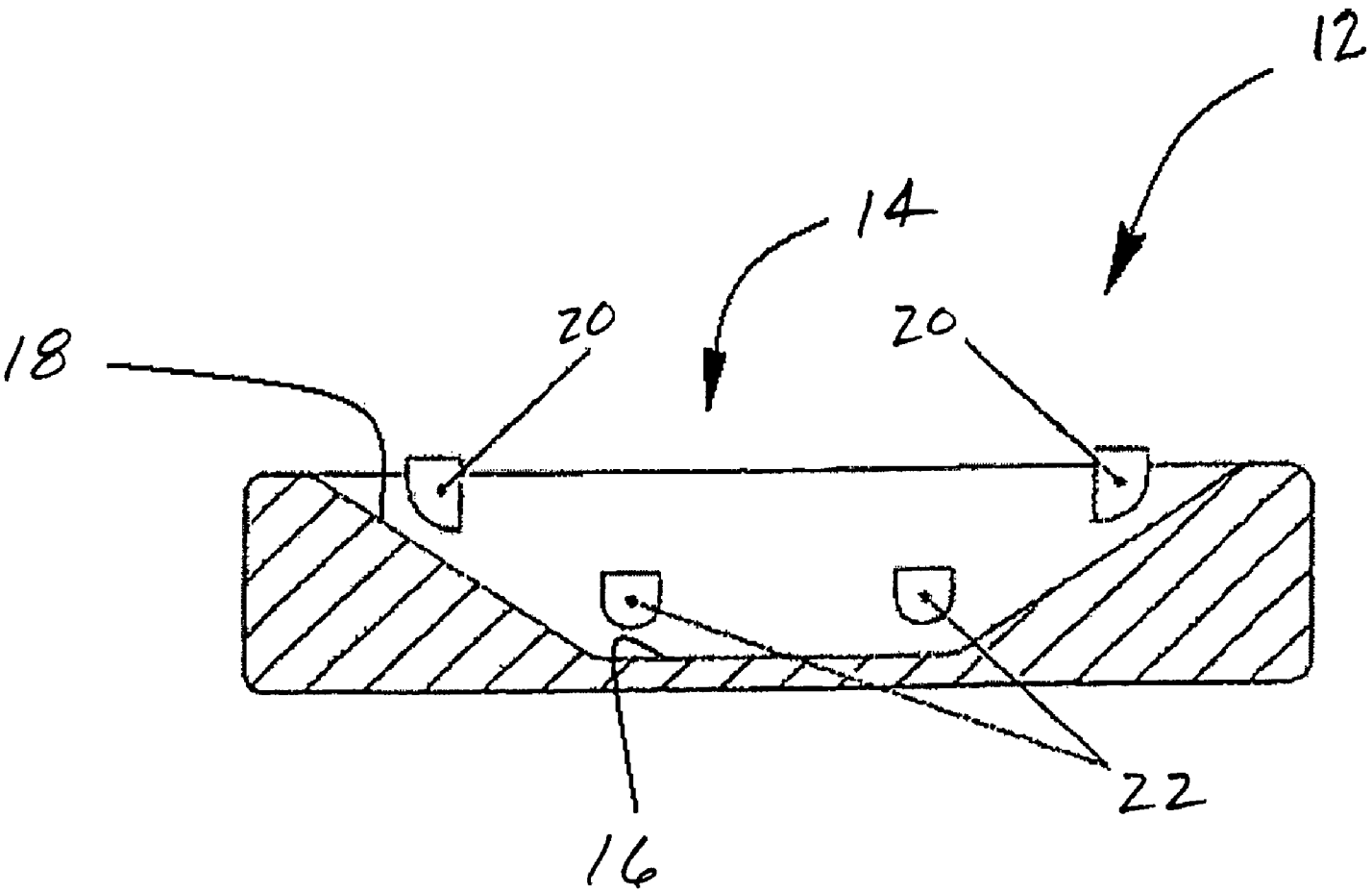
FIG. 2A is a sectional view of the contoured support base that includes a pelvic loading area (PLA) having sloped walls.
Figure 2B:
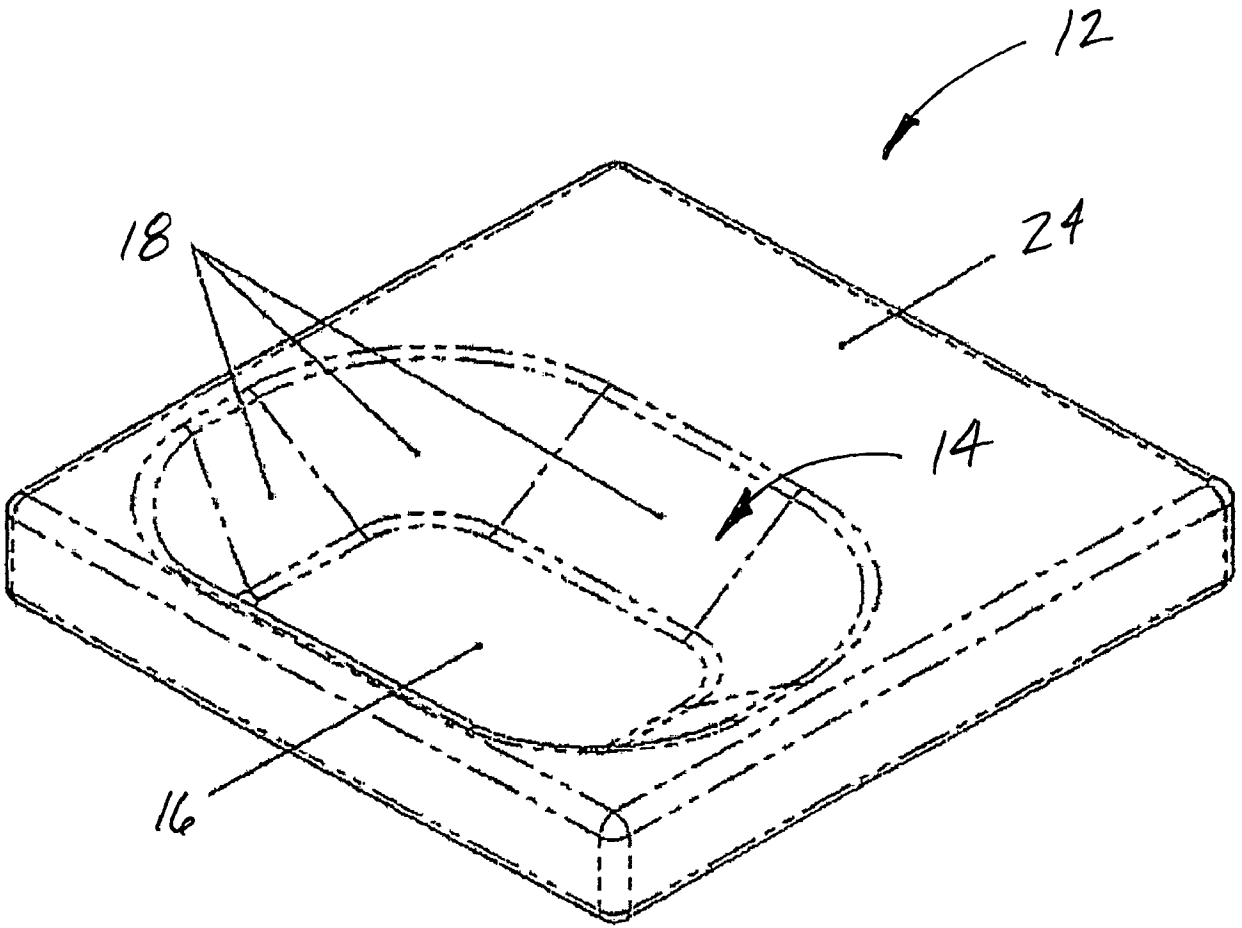
FIG. 2B is a rear perspective view of the contoured support base of FIG. 2A.

Referring now to FIGS. 2A and 2B, the foam base 12 includes a pelvic loading area (PLA), indicated generally at 14. The PLA 14 is illustrated as a depression having depression zones. The depression zones are illustrated as a bottom surface 16 and sides 18 that are sloped toward the bottom surface 16. However, the depression zones may be any surfaces or features such as arcuate sections, radii, bumps or discontinuities that impose a shape requirement onto the cushion insert 13. The sides 18 are illustrated in an angular orientation relative to the bottom surface 16. The angular orientation between the bottom 16 and sides 18 is generally an obtuse angle, greater than ninety degrees relative to the bottom 16. As will be described below, the sides 18 support and contain the cushion insert 13 as the user's weight is applied thereto. The sloping sides 18 of the PLA 14 may be steeper on one or more sides than the other side or sides of the PLA 14. Orientations of the boney prominences of the user relative to the PLA 14 are indicated by symbols representing trochanters 20 and ischial tuberosities 22 of the user. The foam base 12 may further include a leg support area 24 extending from the PLA 14, though such is not required. The leg support area 24 may be generally flat or may be contoured to fit the underside of the user's thigh when seated.

Figure 5:
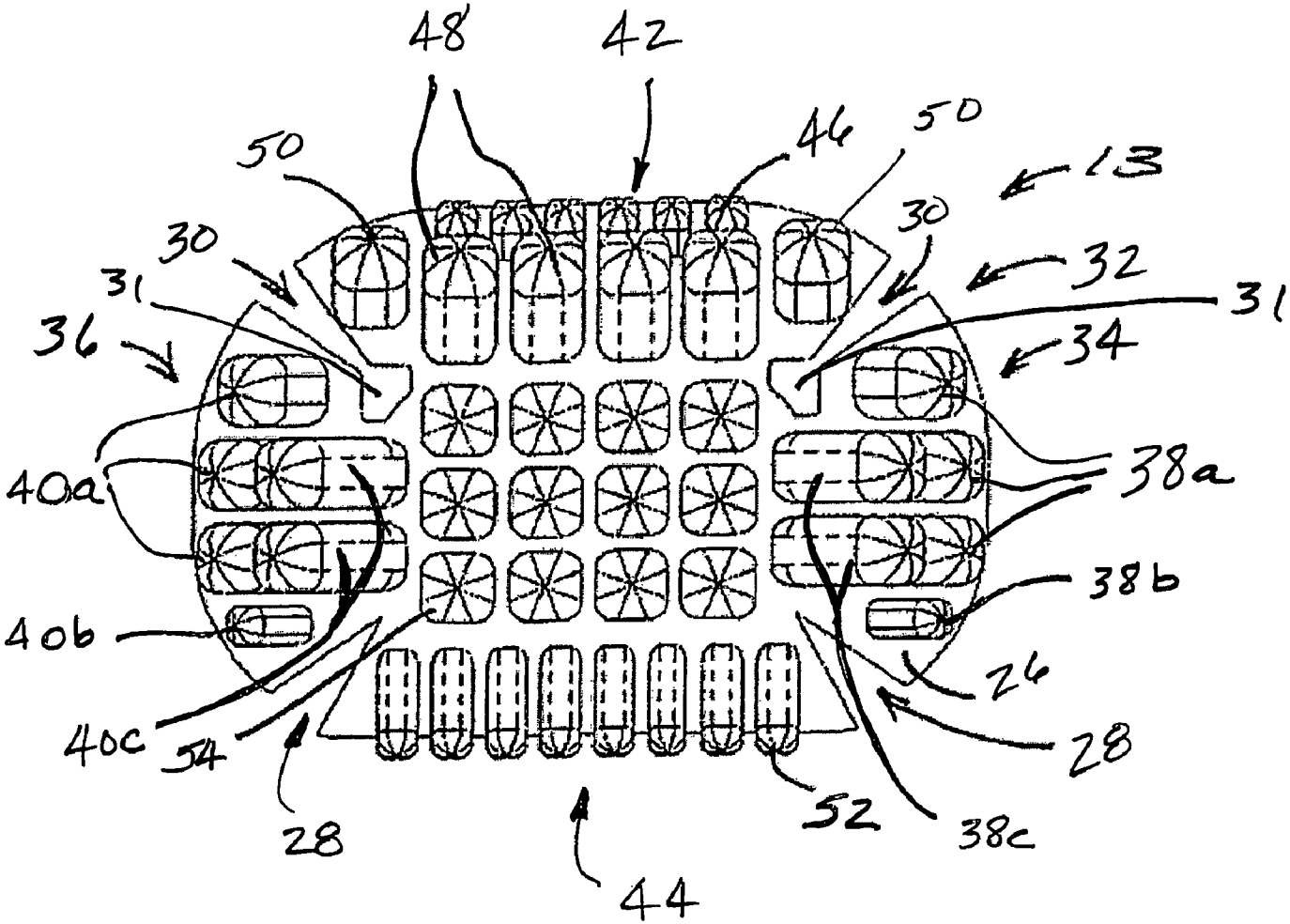
FIG. 5 is a top plan view of a cushion insert, laid out on a generally flat surface, having regions with cells that are not uniformly sized, shaped and oriented.
Figure 6:
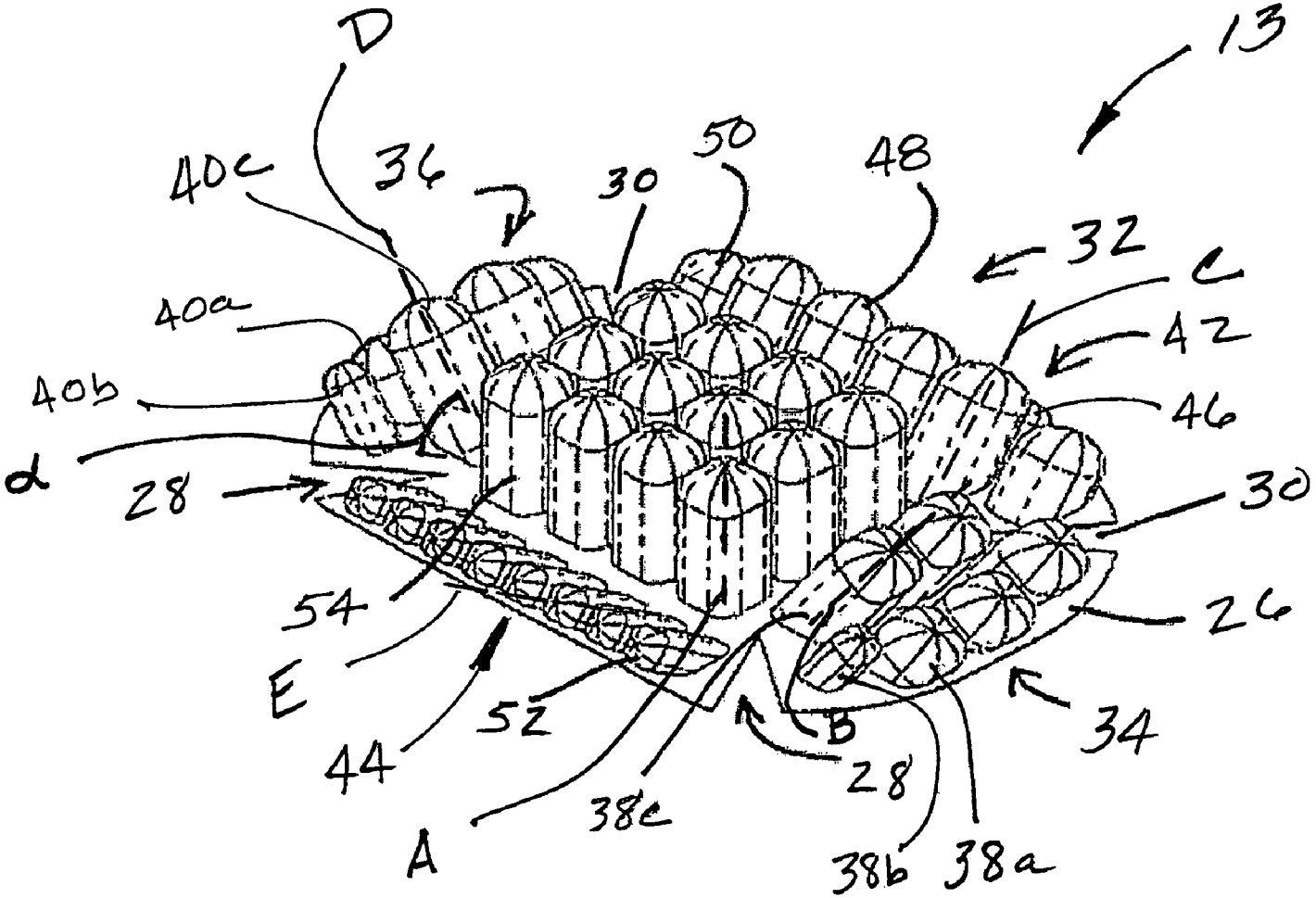
FIG. 6 is a rear perspective view of the cushion insert and the regions shown in FIG. 5.
Figure 7:
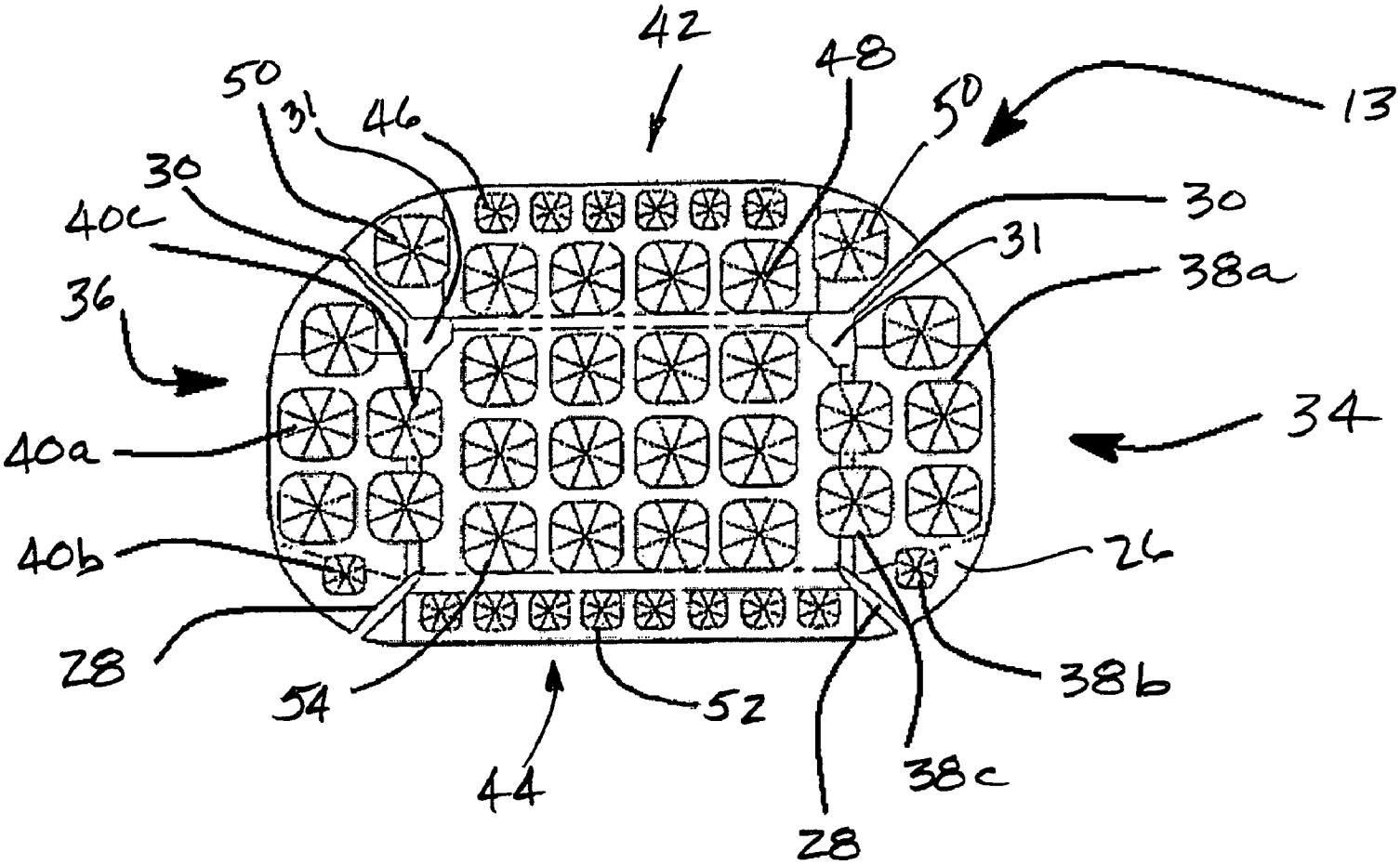
FIG. 7 is a top plan view of the cushion insert shown in FIG. 5, wherein the regions of the insert are oriented so that they may be disposed along the bottom, sloped walls and radii corners of the PLA of the contoured support base.
Figure 8:
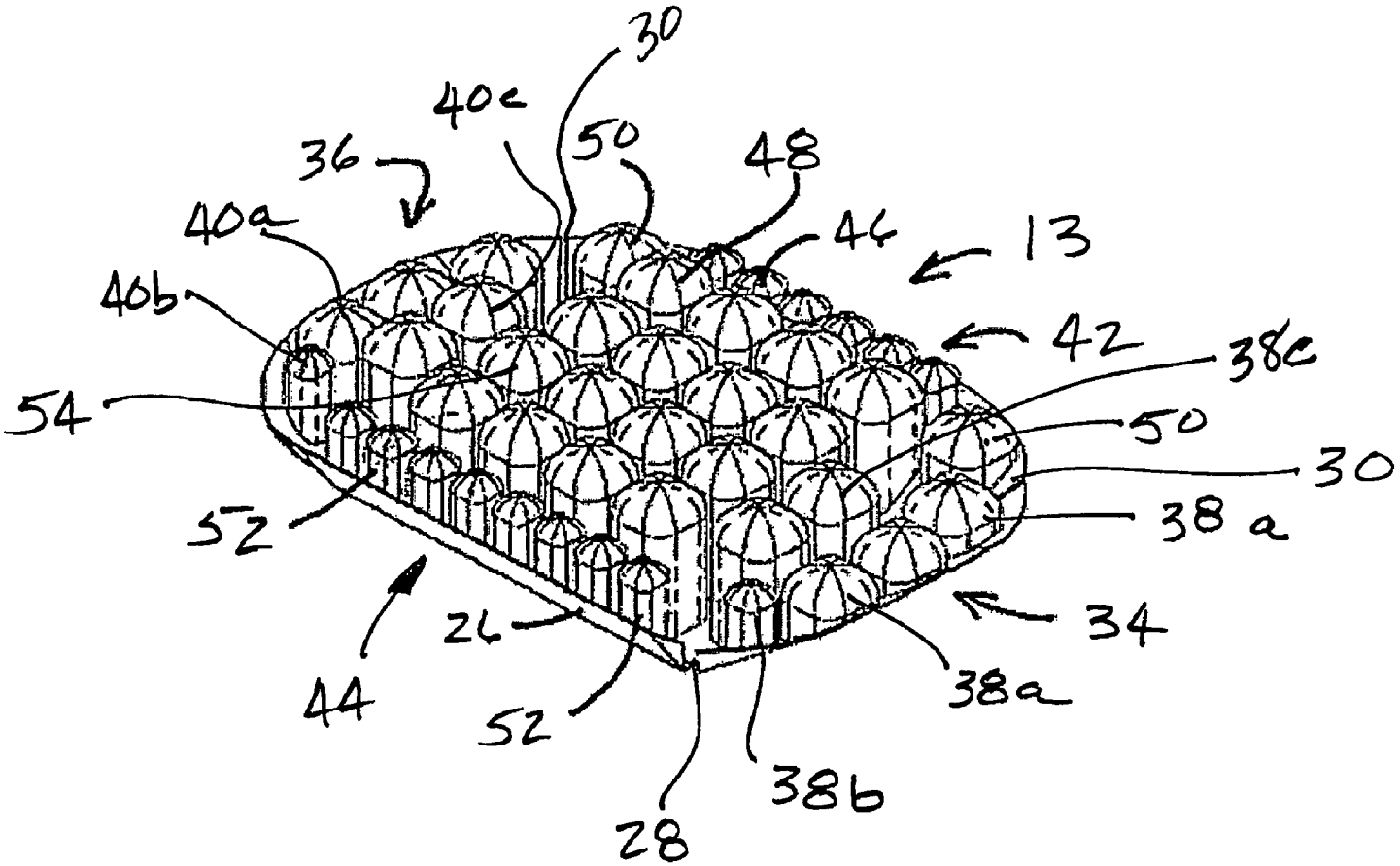
FIG. 8 is a rear perspective view of the cushion insert shown in FIG. 7.

Referring now to FIGS. 5 and 6, the cushion insert 13 is illustrated, in a generally flat orientation, prior to insertion in the PLA 14 The cushion insert 13 is illustrated as a generally oval or rectangular structure, though any shape may be used. The general shape of the cushion insert 13 is similar to the shape of the PLA 14. The cushion insert 13 includes a flexible base portion 26 having first and second notches 28 and 30, respectively. The notches 28 and 30 are illustrated as being oriented in the corners or a point of transition from one side to another. However, the notches 28 and 30 may be located at any suitable location that facilitates positioning the cushion insert 13 within the PLA 14. The notches 28 and 30 may alternatively be creased or pleated areas of the flexible base portion 26 that are subsequently folded against the sloped sides 18, rather than cut out areas as shown. The first notches 28 are shown as being generally triangular in shape, though such is not required. The edges of the first notches 28 are configured to be generally brought together during insertion of the cushion insert 13 into the PLA 14, as will be described below. The second notches 30 are generally triangular in shape and may include a terminal void 31, as shown in FIG. 5. The terminal void 31 allows the edges of the second notch 30 to be brought together when the cushion insert 13 is inserted into the PLA 14. As the edges of the second notch 30 are brought together for conformance of the base 26 to the shape of the PLA14, the terminal void 31 accommodates a steeper incline of the sides 18 without causing a wrinkle or other discontinuity at the terminal end of the second notch 30. Such a discontinuity, over time, may cause cracking or other damage to the base 26 or the cells 32. Further more, discontinuities may also prevent the cushion insert 13 from properly conforming to the shape of the PLA 14. Once in place, the edges of the notches 28 and 30 may be spaced apart, touching, or overlapping.

Figure 10:
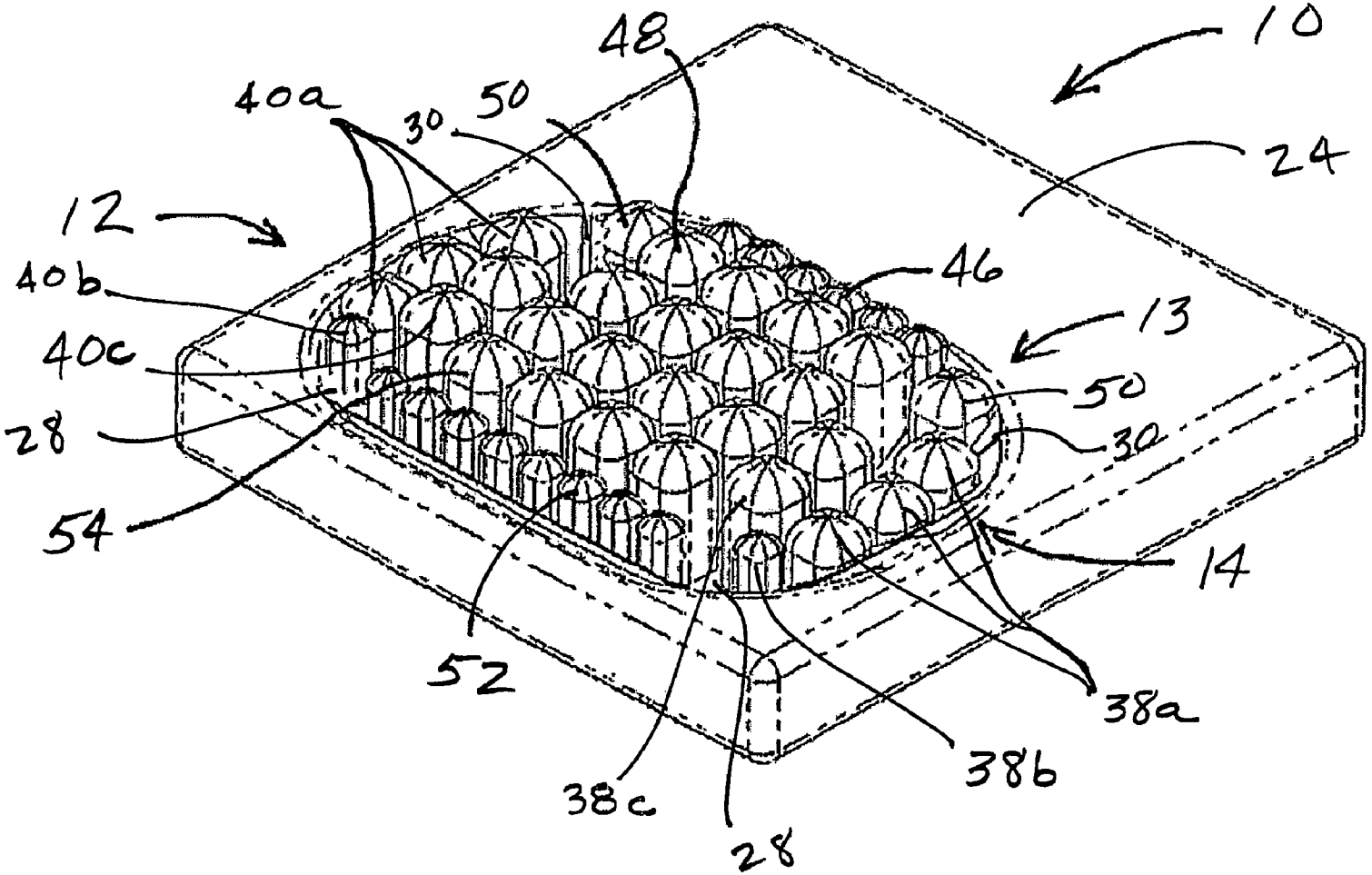
FIG. 10 is a rear perspective view of the cushion insert shown in FIG. 7 disposed in the PLA of the foam base.
Figure 11:
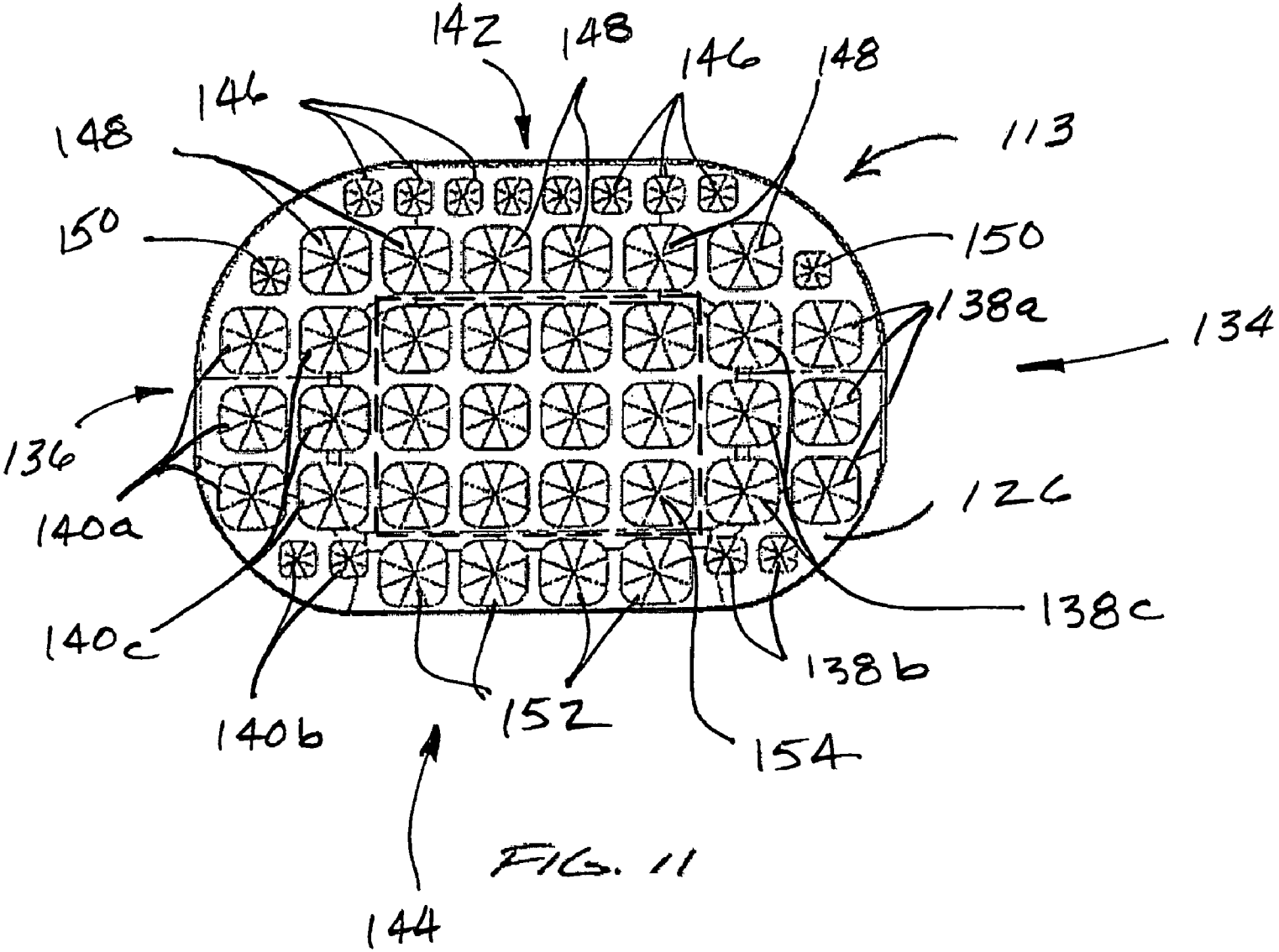
FIG. 11 is a top plan view of another embodiment of a cushion insert that is pre-contoured for disposition along the bottom, sloped walls and radii corners of the PLA.
Figure 12:
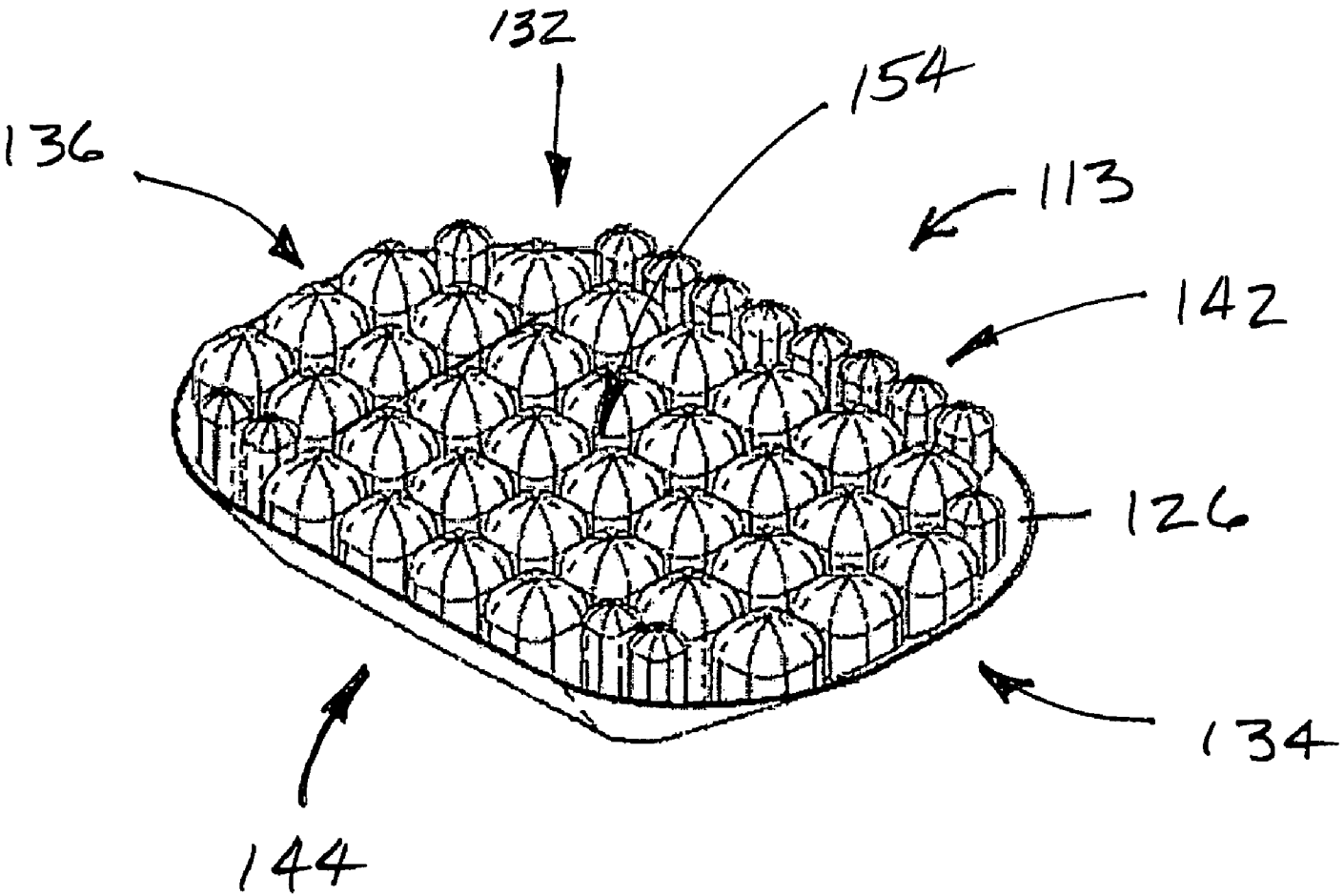
FIG. 12 is a rear perspective view of the pre-contoured cushion insert shown in FIG. 11.
Figure 13:
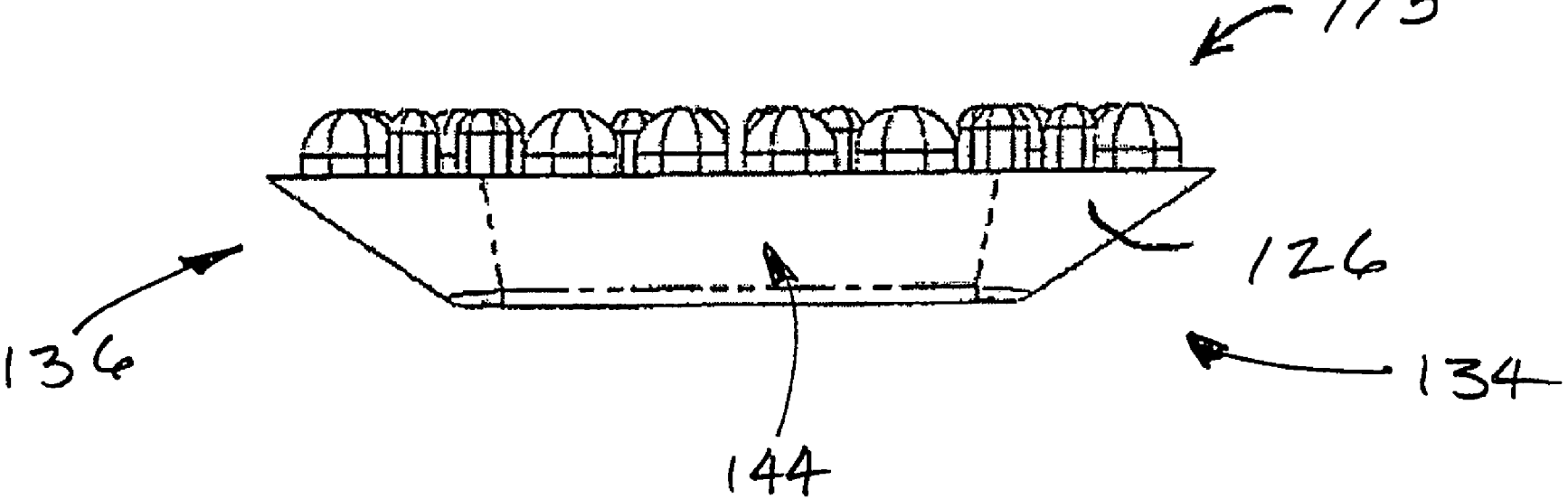
FIG. 13 is a rear elevational view of the pre-contoured air insert shown in FIG. 11.
Figure 14:
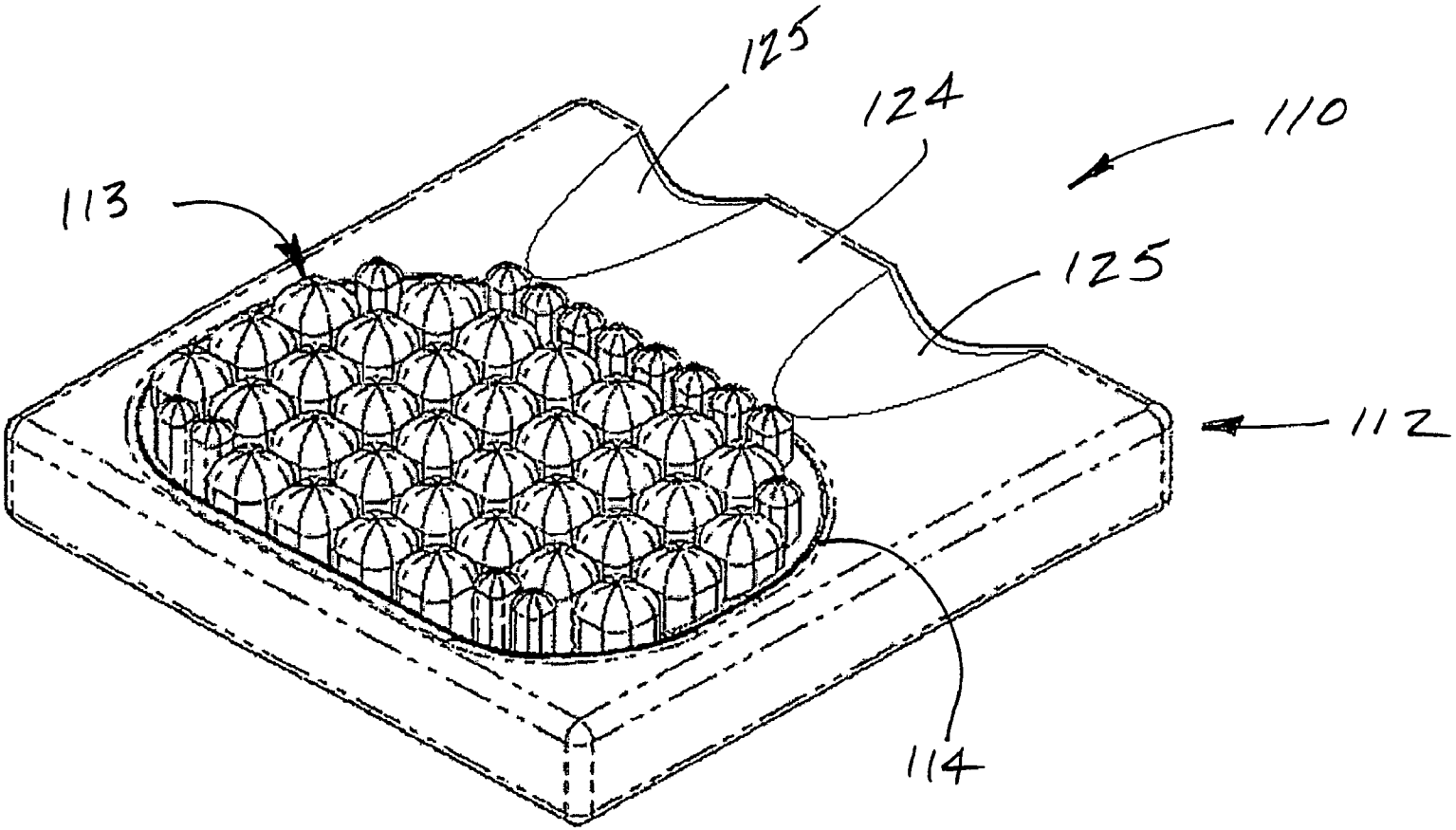
FIG. 14 is a rear perspective view of the pre-contoured cushion insert shown in FIG. 11 and disposed in the PLA of a foam base.

The cushion insert 13 further includes a plurality of cells, shown generally at 32, extending from the base portion 26. The illustrated plurality of cells 32 are hollow and may be fluid filled cells that may include gaseous, liquid, or thixotropic fluids such as, for example, air, nitrogen, water, highly viscous gels, pastes, and the like. The cells 32, or any number of cells 32, may be partially or completely filled with fluid. The cells 32 may also be partially or completely filled with more than one type of fluid. Alternatively, the cells 32 may be generally solid foam cells that include interstitial voids that may have fluid contained therein. In the illustrated embodiment of FIGS. 5 and 6, the cells 32 are illustrated as elongated columns extending from the base portion 26 and having a generally square cross section. However, any shape may be used. Additionally, the cells 32 may be any size, whether the uniform or non-uniform, relative to other cells. The cells 32 are structured and arranged on the base portion 26 in relative orientations such that, when the cushion insert 13 is positioned in the PLA 14 of the foam base 12, the top portions of the cells 32 form a substantially planar surface as illustrated in FIG. 10. The illustrated orientation of the cells 32 is such that the greater weight distribution of the user falls onto the larger cross sectioned cells and the lower weight concentrations are supported by the cells of smaller cross section. Other configurations can be used. As shown in FIG. 6 the cells 32 are arranged on the base portion 26 such that the base portion defines regions. The cells 32 further include axes, such as axes A, B, C, D, and E that define a centerline or other feature consistent between the cells 32.

As shown in FIGS. 5 and 6, the cushion insert 13 includes side regions 34 and 36. The side region 34 is shown having first row cells 38*a* and 38*b* and second row cells 38*c* that have axes B that are oriented at an acute angle, α, relative to the base portion 26 when the insert 13 is placed on a flat surface. The side region 36 is shown having first row cells 40*a* and 40*b* and second row cells 40*c* that also have axes D and are also oriented at an acute angle relative to the base portion 26, though opposite in direction from the cells of side region 34. Though shown as having two rows of cells, the side regions 34 and 36 may have any number of cells arranged in any pattern or orientation, including a random orientation. The first row cells 38*a*, 38*b* and 40*a*, 40*b* are illustrated as different sized cells, though such is not required. The cells 38*b* and 40*b* are shown as a smaller size than the cells 38*a* and 40*a*, respectively, in order to provide support at the point where the notches 28 are folded. The first row cells 38*a*, 38*b* and 40*a*, 40*b* are oriented relative to the base 26 at a similar angle as the second row cells 38*c* and 40*c*, respectively, though such is not required. The first and second row cells 38*a*, 38*b*, 38*c* and 40*a*, 40*b*, 40*c* are generally angled outwardly, toward the outer perimeter of the cushion insert 13. The first row cells 38*a*, 38*b* and 40*a*, 40*b* have a shorter standout or height from the base portion 26, in the unfolded position, than the second row cells 38*c* and 40*c*, respectively. The shorter standout of the first row cells 38*a*, 38*b* and 40*a*, 40*b* and the longer standout of the second row cells 38*c* and 40*c* account for their relative positions along the slope of the sides 18 of the PLA 14. The differing standouts provide a cushion insert 13, when folded or otherwise inserted into the PLA 14, having a substantially planar surface, or a stepped substantially planar surface, that contacts the user.

The cushion insert 13 further includes a front region 42 and a rear region 44. The front region 42 includes first row cells 46, second row cells 48, and corner cells 50. Similar to the side regions 34 and 36 described above, the first row cells 46 are shown having a shorter standout, relative to the base 26, than the second row cells 48. The difference in standouts, likewise, accommodates the relative positions of the cells against the sloping sides 18, when assembled on the PLA 14. The first row cells 46 are shown as smaller sized cells positioned closer to the perimeter of the cushion insert 13 than the second row cells 48, though such is not required. The first and second row cells 46 and 48 are angled relative to the base portion 26, similar to the cells of the side regions 34 and 36 described above, though such an angular orientation is not required. The first and second row cells 46 and 48 may also be angled at a steeper or shallower angle than the angle of the cells of the side regions 34 and 36 in order to accommodate a difference in the front angle versus the side angles of the sloping sides 18 of the PLA 14. The corner cells 50 are similarly angled relative to the base portion 26 to lean or otherwise be oriented toward the perimeter of the cushion insert 13. The corner cells 50 may be angled toward both the perimeter of the front region and the perimeter of the side regions 34 and 36, in a compound angle orientation, though such a compound angle is not required. The rear region 44 is illustrated having one row of similarly shaped cells 52, though being shaped as such is not required. The rear region cells 52 are also angled toward the perimeter of the cushion insert 13 such that when positioned in the PLA 14 the cells 52 form a substantially planar orientation.

Figure 9:
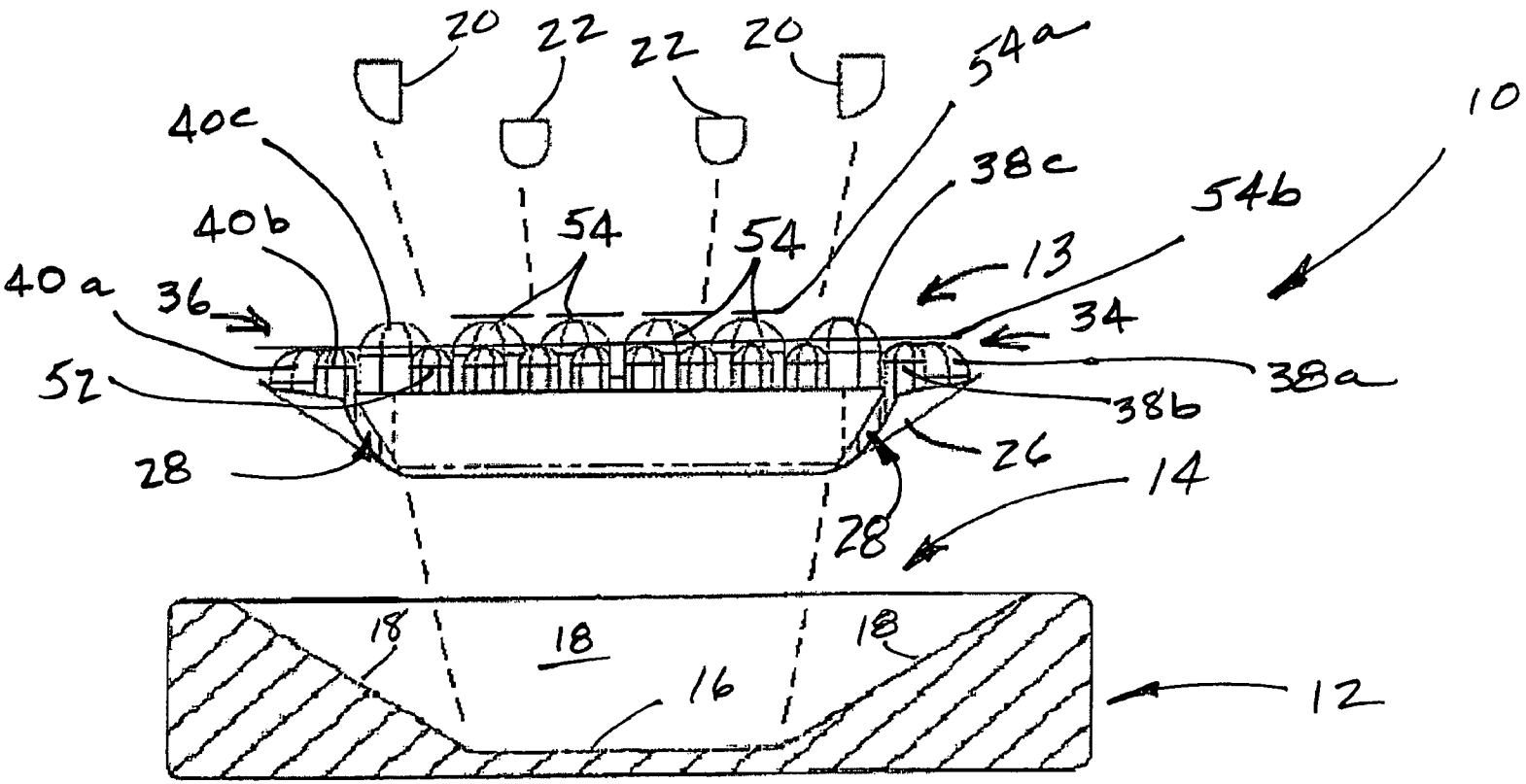
FIG. 9 is a rear elevational view of the cushion insert shown in FIG. 7.

There is further included on the cushion insert 13 a plurality of center region cells 54. As shown in FIG. 9, the uppermost portions of the center region cells 54 may form a substantially planar surface 54*a* that is above a substantially planar surface 54*b* of the remaining cells 32. Alternatively, the center region cells 54 may be below the remaining cells 32 if so desired. The center region cells 54 are positioned substantially perpendicular to the base 26 such that their orientation relative to the bottom 16 of the PLA 14 is also substantially perpendicular. However, when the bottom 16 of the PLA 14 is shaped other than generally flat, the center region cells 54 may be oriented at an angle to the base 26. The angular orientation may be such that the center region cells 54 are substantially perpendicular to the associated portion of the bottom surface 16. The center region cells 54 are typically sized to isolate and support the boney prominences of the user relative to the seat bottom 4 of the wheelchair 2. The center region cells 54 may also support a majority of the weight of the user, though such is not required. Typically, the cells 32 may form a generally parallel orientation relative to adjacent cells when the cushion insert 13 is inserted in the PLA 14, though such is not required.

Referring now to FIGS. 7-10, the cushion insert 13 is shown in a folded or contained condition ready to be positioned in the PLA 14 of the foam base 12. The first and second side regions 34 and 36 are moved toward the center region cells 54 of the cushion insert 13 such that the second row cells 38*c* and 40*c* are positioned proximate to, or alternatively located against, the center region cells 54. The first row cells 38*a*, 38*b*, 40*a*, and 40*b* are positioned proximate to or against the second row cells 38*c* and 40*c*. Likewise, the front region 42 and the rear region 44 are moved toward the center of the cushion insert 13. The first and second notches 28 and 30 are shown with the edges drawn together such that the side regions may be positioned against the center region without significant distortion. The resulting shape of the base 26 of the cushion insert 13 is generally complimentary to the shape of the PLA 14.

Referring now to FIGS. 9 and 10, when the cushion insert 13 is folded and positioned within the PLA 14, the center region cells 54 form an elevated, substantially planar surface and the cells of the front rear and side regions form another substantially planar surface. The center region cells 54 insulate the boney prominences of the user from contact with the seat bottom 4 by increasing the surface area to support the user. The increased surface area supplied by the cushion insert 13 prevents the user's ischial tuberosities 22 and trochanters 20 from contacting the seat bottom 4 in a highly stressed manner. The center region cells 54 may also support a majority of the user's weight as applied by the ischial tuberosities 22.

When the user's weight is applied to the PLA cushion assembly 10, the center region cells 54 are compressed and also may deflect outwardly. The outward component of deflection of the center region cells 54 may be resisted by the cells of the first and second side regions 34 and 36 and the front and rear regions 42 and 44. By virtue of the sloping angle of the sides 18 of the PLA 14 and the complimentary angle of the cells 38*a-c*, 40*a-c*, 46, 48, 50, and 52, the cells resist the outward component of deflection of the center region cells 54. The trochanters 20 may be supported by the cells 38*a-c* and 40*a-c* in a combination of shear and compression by virtue of the slope angle of the sides 18 of the PLA 14.

The cells 32 may be fabricated from a resiliently flexible inflatable material such as neoprene, plastic or the like. The cells 32 may be formed by conventional dip molding or vacuum molding. The volume of fluid within the cells 32 may be adjustable and the cells 32 may be interconnected through the base portion 26 so that fluid may flow from cell to cell. Additionally, when interconnected, the cells 32 may be in communication with valves (not shown) to alter or otherwise regulate fluid flow therebetween. The cells 32 may be inflated by means of an inflation tube (not shown), which may be in fluid communication with one of the interconnected cells. The tube may include a valve that is operable to open and close. When fluid, such as air, is introduced through the tube, the air may flow from cell to cell so that the pressure in the cells 32 is equalized. The cells 32 may exert a substantially uniform force on the buttocks and legs of a user. On the other hand, the cells 32 of the cushion insert 13 may be divided into individual inflation zones, such as the first and second side regions 34 and 36, the front and rear regions 42 and 44 and the center region cells 54, where each zone may be inflated to a desired pressure.

When the cushion insert 13 is in use by a seated user, the cells 32 may deform under load to equalize forces and conform closely to the shape of the user's buttocks, thereby spreading the load and reducing the deformation of skin tissue. The shape of the cells 32 may be selected to deform without substantial resistance other than that provided by compressing the volume of fluid within the cells 32. The height and orientation of the cells accommodates the shape and contour of the PLA 14, to conform to the sloped walls 18 and radii corners of the PLA 14. The cells 32 may have side walls that are generally straight, as illustrated, or the cells may have convoluted side walls to control the deflections of the cells 32 when the user's weight is applied to the PLA cushion assembly 10.

Referring now to FIGS. 11-14, an embodiment of a PLA cushion assembly 110 is illustrated having a contoured foam base 112 including a pelvic loading area (PLA) 114 and a cushion insert 113. The contoured foam base 112 may include a leg support area 124 that may have depressions forming a pair of spaced-apart leg contours 125, though such is not required. The cushion insert 113 includes a base 126 that is molded or otherwise formed in a pre-contoured shape including a plurality of cells 132. Where possible, similar reference numbers will be used to describe similar features and elements to those described in the embodiment above. The shape of the pre-contoured base 126 of the cushion insert 113 is molded to fit into the PLA 114 of a foam base 112. The pre-contoured cushion insert 113 may be used in the same way and have a similar effect as the cushion insert 13 described above. The pre-contoured cushion insert 113 may include similar regions corresponding to relative positions of the foam base 114 as the cushion insert 13 described above. For example, side regions 134 and 136 and front and rear regions 142 and 144 may form a continuous perimeter about a section formed by a plurality of center region cells 154.

The first side region 134 may include first and second row cells 138*a* and 138*c*, which are illustrated having the same size and shape, though such is not required. The first and second row cells 138*a* and 138*c* are angled relative to the base 126 such that the cells 138*a* and 138*c* are generally parallel to adjacent cells 132. The first side region 134 may also include corner cells 138*b* that are also angled relative to the base 126 and may further include compound angles as described above. The corner cells 138*b* are illustrated as two cells that are smaller in size that the first and second row cells, though such is not required. Similarly, the second side region 136 also includes first and second row cells 140*a* and 140*c* and corner cells 140*b*. These cells may be similarly angled, though pointing in an opposite direction, to the cells of the first side region. The cells of the first and second side regions 134 and 136 are angled relative to the base in order to maintain a generally parallel relative orientation.

The cushion inert 113 further includes a front region 142 and a rear region 144. The front region 142 is illustrated having first row cells 146 and second row cells 148, though any number of cells and any relative orientation may be provided. The first row cells 146 are illustrated as being smaller than the second row cells 148, though the cells 146 and 148 may be any desired relative size or the same size. The smaller cells 146 are designed and sized to support the lower weight requirements of the front pelvic region of the user. The rear region 144 is shown having a single row of rear cells 152, though any number, size and orientation of cells may be provided. The rear region cells 152 are configured to support the user's coccyx or tail bone region. Alternatively, the cells 132 may have any desired relative size, shape, and dispersion pattern across the cushion insert 113.

Figure 3:
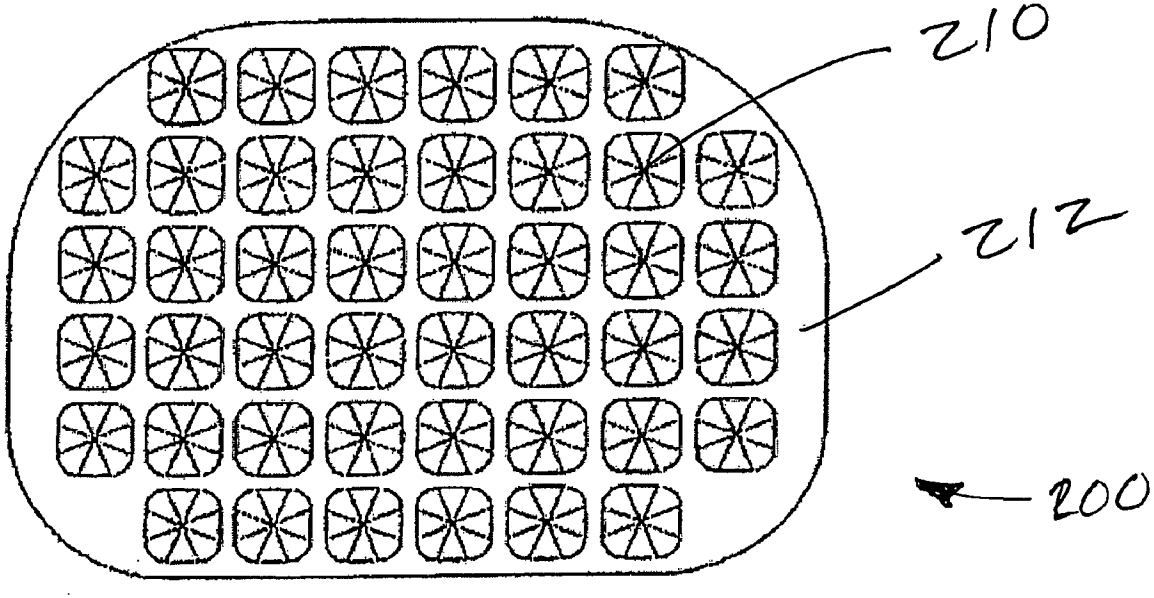
FIG. 3 (PRIOR ART)
FIG. 3 is a top plan view of a prior art insert having cells uniformly sized, shaped and oriented.
Figure 4:
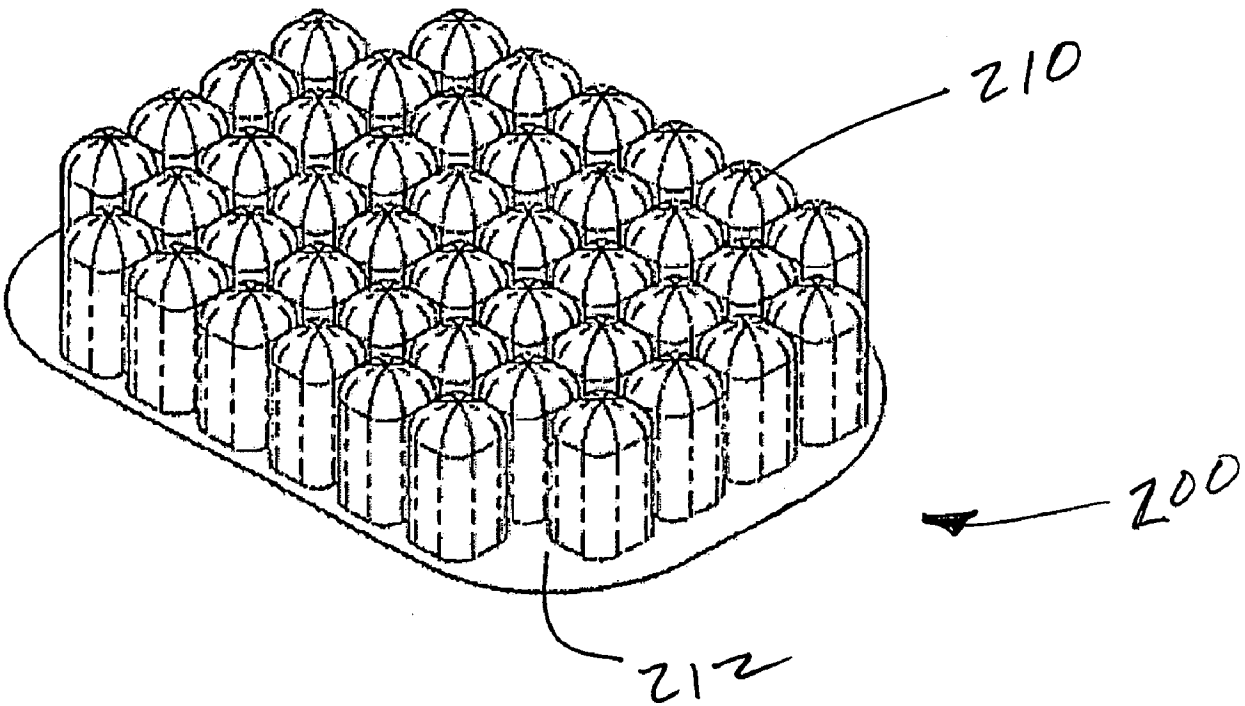
FIG. 4 (PRIOR ART)
FIG. 4 is a rear perspective view of the prior art insert of FIG. 3.

Referring now to FIGS. 3 and 4, there is illustrated a prior art air cushion indicated generally at 200. The prior art air cushion 200 includes a plurality of air filled cells 210 positioned across a base 212. The base 212 is formed in a generally flat configuration with the cells 210 arranged generally perpendicular thereto. The cells 210 are illustrated having the same size and shape. When folded or otherwise positioned in a pelvic loading area of a foam base, the base 212 and the cells are distorted such that some cells are no longer oriented in a generally parallel relationship relative to the remaining cells.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A seat cushion assembly adapted for supporting boney prominences of a user seated in a wheelchair comprising:

a contoured support base having a depression with sloping sides; and a cushion insert having a base portion and plurality of cells where each cell defines a longitudinal axis, the plurality of cells being arranged across the base portion such that the longitudinal axes of at least two of the cells are positioned in a relative angular and non-parallel orientation when the cushion insert is positioned on a generally flat surface, the base portion configured to conform to the depression such that the longitudinal axes the cells are arranged in a generally relative parallel orientation when the cushion insert is disposed within the depression and positioned on the sloping sides.

2. The seat cushion assembly of claim 1 wherein the contoured support base is a foam base and the depression is a pelvic loading area having a bottom surface.

3. The seat cushion assembly of claim 1 wherein the cushion insert includes a center region containing cells and side regions having cells, the side regions being movable relative to the center region such that the cells of the side regions and the center region are oriented generally parallel when disposed in the depression of the contoured base.

4. The seat cushion assembly of claim 3 wherein the base portion includes a front region that is adjacent to one of the side regions and a rear region that is adjacent to the other one of the side regions.

5. The seat cushion assembly of claim 4 wherein a notch is disposed between at least one of the adjacent regions.

6. The seat cushion assembly of claim 1 wherein the cells are not uniform in size and shape.

7. The seat cushion assembly of claim 1 wherein the cells have an uppermost portion, the uppermost portion of the cells of the cushion insert form a substantially planar surface.

8. The seat cushion assembly of claim 1 wherein the cushion insert includes a center region containing cells and side regions having cells, the center region cells form a first substantially planar surface and the cells of the side regions form a second substantially planar surface that is spaced apart from the first substantially planar surface.

9. The seat cushion assembly of claim 1 wherein the base portion of the cushion insert is pre-contoured such that the shape of the base portion is substantially similar to the depression of the contoured support base.

10. The seat cushion assembly of claim 3 wherein the side regions are a first side region and a second side region, the first and second side regions having cells, the cells defining axes that are oriented at an acute angle relative to the base portion when the cushion insert is placed on a flat surface.

11. A seat cushion assembly configured to support a user in a seated position comprising:

a contoured support base having a depression, the depression having surface features defining depression zones; and a cushion insert having a base portion and a plurality of cells arranged across the base portion, the base portion defining regions that correspond with the depression zones, the depression zones being further configured to impose a shape requirement onto the cushion insert, wherein the cells in the regions are configured to compliment the depression surface features of the corresponding depression zones such that the cells each define a longitudinal axis, where the longitudinal axes of the cells are arranged in a generally relative parallel orientation in response to the shape requirement of the depression zones when the cushion insert is disposed within the depression to provide a seating area for the user and the longitudinal axes of the cells of one region are in a relative angular and non-parallel orientation with respect to the longitudinal axes of the cells of at least another region when the cushion insert is positioned on a generally flat surface.

* * * * *